US007398664B1

(12) United States Patent
Weinerman et al.

(10) Patent No.: US 7,398,664 B1
(45) Date of Patent: Jul. 15, 2008

(54) HANDLE AND HOUSING ASSEMBLY

(75) Inventors: Lee S. Weinerman, Medina, OH (US); Scott S. Kalanish, Hiram, OH (US)

(73) Assignee: The Eastern Company, Cleveland, OH (US)

( * ) Notice: Subject to any disclaimer, the term of this patent is extended or adjusted under 35 U.S.C. 154(b) by 79 days.

(21) Appl. No.: 11/079,328

(22) Filed: Mar. 14, 2005

(51) Int. Cl.
*E05B 13/10* (2006.01)

(52) U.S. Cl. ..... 70/208; 292/207; 292/DIG. 30; 292/DIG. 31

(58) Field of Classification Search ..... 70/208–211, 70/224; 292/363.3, 207, DIG. 30, DIG. 31
See application file for complete search history.

(56) References Cited

U.S. PATENT DOCUMENTS

| | | | | | |
|---|---|---|---|---|---|
| D119,418 | S | | 3/1940 | Anderson et al. | D8/306 |
| 2,402,348 | A | | 6/1946 | Schroeder | 292/164 |
| 2,729,089 | A | | 1/1956 | Pelcin | 70/151 |
| 2,735,706 | A | | 2/1956 | Pelcin | 292/34 |
| 2,991,904 | A | | 7/1961 | Carideo | 220/44 |
| 3,333,878 | A | | 8/1967 | Pelcin | 292/37 |
| 3,457,744 | A | | 7/1969 | Bisbing | 70/82 |
| 3,953,061 | A | | 4/1976 | Hansen et al. | 292/5 |
| 4,370,874 | A | * | 2/1983 | Munn | 70/204 |
| 4,641,865 | A | | 2/1987 | Pastva | 292/5 |
| 4,706,478 | A | * | 11/1987 | Swan et al. | 70/28 |
| 4,714,283 | A | | 12/1987 | Dignan | 292/48 |
| 4,838,054 | A | | 6/1989 | Weinerman et al. | 70/208 |
| 4,892,338 | A | | 1/1990 | Weinerman et al. | 292/35 |
| D316,365 | S | | 4/1991 | Hansen et al. | D8/331 |
| 5,015,019 | A | * | 5/1991 | Razdolsky | 292/200 |
| D317,398 | S | | 6/1991 | Hansen et al. | D8/336 |
| 5,052,869 | A | | 10/1991 | Hansen, II | 410/111 |
| D323,776 | S | | 2/1992 | Hansen | D8/338 |
| D323,970 | S | | 2/1992 | Schlack | D8/341 |
| D328,231 | S | | 7/1992 | Hansen | D8/301 |
| 5,526,660 | A | * | 6/1996 | Bennett et al. | 70/208 |
| 5,585,578 | A | | 12/1996 | Shimotori | 84/95.2 |
| 5,595,076 | A | | 1/1997 | Weinerman et al. | 70/208 |
| D389,393 | S | | 1/1998 | Hansen | D8/310 |
| 5,913,908 | A | * | 6/1999 | Czipri | 70/208 |
| 5,938,248 | A | | 8/1999 | Vickers et al. | 292/36 |
| 5,984,383 | A | | 11/1999 | Parikh et al. | 292/121 |
| D427,882 | S | | 7/2000 | Wytcherley et al. | D8/331 |
| D429,141 | S | | 8/2000 | Antonucci et al. | D8/331 |

(Continued)

*Primary Examiner*—Patricia Engle
*Assistant Examiner*—Christopher Boswell
(74) *Attorney, Agent, or Firm*—David A. Burge

(57) ABSTRACT

A handle and housing assembly includes a housing having front and rear sides. A handle is connected on the front side of the housing to a shaft that extends through the housing along a forwardly-rearwardly extending axis. The handle may be used to turn the shaft, to turn components connected to a rear portion of the shaft, and/or to move shaft-connected components forwardly and rearwardly along the axis of the shaft. In some embodiments, the housing defines a forwardly facing recess, and the handle is nestable within and extendable from the recess. In some embodiments, the handle is nestable within the recess in a variety of orientations. In some embodiments, housing-defined stop formations limit the range through which a shaft-connected component is permitted to turn. In some embodiments, housing-defined formations guide movement of a lock bolt that may engage a shaft-connected component to retain the shaft, the handle and the shaft-connected component in one or a plurality of orientations.

55 Claims, 8 Drawing Sheets

U.S. PATENT DOCUMENTS

| | | | | |
|---|---|---|---|---|
| D442,844 | S | 5/2001 | Mirick | D8/301 |
| D456,237 | S | 4/2002 | Sokurenko et al. | D8/307 |
| D457,803 | S | 5/2002 | Weinerman et al. | D8/338 |
| D459,192 | S | 6/2002 | Weinerman et al. | D8/338 |
| 6,418,761 | B1 * | 7/2002 | Wytcherley et al. | 70/208 |
| 6,490,895 | B1 | 12/2002 | Weinerman et al. | 70/208 |
| D469,678 | S | 2/2003 | Teskey | D8/301 |
| 6,513,353 | B1 | 2/2003 | Weinerman et al. | 70/208 |
| 6,530,250 | B1 * | 3/2003 | Linares et al. | 70/208 |
| 6,532,778 | B2 | 3/2003 | Molzer et al. | 70/208 |
| 6,623,052 | B2 | 9/2003 | Hansen | 292/336.3 |
| D484,024 | S | 12/2003 | Teskey et al. | D8/331 |
| 6,666,053 | B2 | 12/2003 | Sadler | 70/210 |
| 6,668,602 | B2 * | 12/2003 | Graham et al. | 70/208 |
| D488,994 | S | 4/2004 | Hansen | D8/350 |
| D490,292 | S | 5/2004 | Hansen | D8/352 |
| 6,952,940 | B2 | 10/2005 | Molzer et al. | 70/210 |
| D520,328 | S | 5/2006 | Hansen | D8/301 |
| D523,726 | S | 6/2006 | Weinerman et al. | D8/307 |
| 7,124,475 | B2 | 10/2006 | Jeffries | 16/445 |
| 2004/0083780 | A1 * | 5/2004 | Graham et al. | 70/208 |
| 2005/0257582 | A1 * | 11/2005 | Minix | 70/208 |
| 2006/0185408 | A1 * | 8/2006 | Graham et al. | 70/208 |

* cited by examiner

HANDLE AND HOUSING ASSEMBLY

REFERENCE TO RELEVANT APPLICATIONS

Filed concurrently herewith by the inventors named herein are the following subject-matter related design applications, the disclosures of which are incorporated herein by reference:

1) FRONT PORTIONS OF A HANDLE AND HOUSING ASSEMBLY, Ser. No. 29/225,254;

2) FRONT PORTIONS OF THE HOUSING OF A HANDLE AND HOUSING ASSEMBLY, Ser. No. 29/225, 253; and 3) FRONT PORTIONS OF THE HANDLE OF A HANDLE AND HOUSING ASSEMBLY, Ser. No. 29/225, 255.

BACKGROUND OF THE INVENTION

Field of the Invention

The present invention relates to handle and housing assemblies that can be used to operate devices such as latches that retain closures in closed positions, and, more particularly, to handle and housing assemblies that employ a housing having a front side and a rear side, and a handle that is connected on the front side of the housing to a shaft that extends through the housing along a forwardly-rearwardly extending principal axis, wherein the handle is graspable to turn the shaft about the principal axis between first and second orientations.

Commercially available handle and housing assemblies have a wide range of uses. Many are purchased by manufacturers of vehicle cabinetry, industrial cabinets, toolboxes and the like for use in products that have devices such as latches that can be operated by turning a handle relative to an associated housing. Some handle and housing assemblies have housings that define forwardly facing recesses and employ handles that can be retracted to nest within the recesses. When a nestable handle is moved to an extended position wherein it projects forwardly from an associated recess, the handle can be grasped and turned about a forwardly-rearwardly extending axis of the recess to turn a handle-connected shaft that extends through the housing along the axis.

Some commercially available handle and housing assemblies are lockable, either by inserting and turning a key in a housing-carried lock, or by attaching a padlock to the assembly to prevent relative movement of selected components of the assembly.

The handle-connected shafts of some handle and housing assemblies are used to move latch elements into and out of latched positions wherein the latch elements are engageable with strikes or other structure that can be engaged to retain associated closures in closed positions. The shafts of other handle and housing assemblies are used to turn so-called "latch operating elements" between non-operated and operated positions. Links connected to the latch operating elements cause remotely located latches to operate when the operating elements are turned to their operated positions. Rigid links such as rods may be pushed or pulled by a latch operating element to cause one or more remotely located latches to operate. Flexible links such as cables may be pulled by a latch operating element to cause one or more remotely located latches to operate.

Patents assigned to The Eastern Company which disclose handle and housing assemblies having handles that are movable between retracted and extended positions, and that can be turned, while extended, to turn shafts of the assemblies, include U.S. Pat. No. 4,838,067 issued Jun. 13, 1989 to Weinerman et al, U.S. Pat. No. 4,838,054 issued Jun. 13, 1989 to Weinerman et al, and U.S. Pat. No. 4,706,478 issued Nov. 17, 1987 to Swan et al, the disclosures of which are incorporated herein by reference.

A patent assigned to The Eastern Company which discloses a handle and housing assembly that not only turns a shaft-connected latch element between latched and unlatched positions but also turns a shaft-connected latch operating element to move links to release a pair of remotely located latches, is U.S. Pat. No. 4,641,865 issued Feb. 10, 1987 to Pastva, the disclosure of which is incorporated herein by reference.

Other patents assigned to The Eastern Company that disclose a variety of types of handle and housing assemblies used to operate pairs of links to release remotely located latches include U.S. Pat. No. 6,513,353 issued Feb. 4, 2003 to Weinerman et al, U.S. Pat. No. 6,490,895 issued Dec. 10, 2002 to Weinerman et al, U.S. Pat. No. 5,595,076 issued Jan. 21, 1997 to Weinerman et al, U.S. Pat. No. 4,892,338 issued Jan. 9, 1990 to Weinerman et al, U.S. Pat. No. 3,333,878 issued Aug. 1, 1961 to Pelcin, U.S. Pat. No. 2,735,706 issued Feb. 21, 1956 to Pelcin, and U.S. Pat. No. 2,729,089 issued Jan. 3, 1956 to Pelcin, the disclosures of which are incorporated herein by reference.

SUMMARY OF THE INVENTION

The present invention provides housing and handle assemblies that each include a housing having a front side and a rear side, and that each have a handle that is connected to a shaft on the front side of the housing—a shaft that extends through the housing and can be turned by the handle about a forwardly-rearwardly extending axis, referred to as a "principal axis." Features of the invention include what will be referred to as "front features" and "rear features." Some embodiments of the invention incorporate only front features; some incorporate only rear features; and some advantageously incorporate combinations of both.

In some embodiments that employ "front features" of the invention, the housing defines a forwardly-facing recess that is configured to permit the handle to nest in different orientations in the recess. In some embodiments, the recess has portions or "sectors" arrayed about the principal axis, and a graspable portion of the handle is permitted to nest within selected ones of the sectors. In one form of preferred practice, the recess has four sectors, and the handle is configured to permit nesting of the graspable portion of the handle in any selected one of the four sectors of the recess.

In some embodiments that employ "front features" of the invention, housing-defined formations located near the periphery of a forwardly-facing housing-defined recess are provided to engage a nested handle to support the nested handle and/or to limit or inhibit turning of the nested handle about the principal axis. In some embodiments, one or more of these formations may be utilized in a first way to support the handle when the handle is nested in one orientation within the recess, and in a second way to inhibit turning of the handle when the handle is nested in a different orientation within the recess.

In some embodiments that employ "front features" of the invention, the handle is connected by a pivot pin to front portions of the associated shaft so the handle can pivot relative to the shaft as the handle moves between an extended position and one or more retracted, nested positions. In some embodiments, the handle is coupled to the shaft by handle-to-shaft connection elements that include a cam element configured to move the shaft axially (i.e., forwardly or rearwardly along the principal axis) as the handle pivots or otherwise moves between its extended and retracted positions. In some embodiments, a cam included among elements of the handle-to-shaft connection cooperates with a shaft-carried spring to cause the handle to be biased toward one or more of the extended and retracted positions—an arrangement that may utilize the biasing action of the spring to aid in moving the handle to one or more of its extended and retracted positions.

In some embodiments the handle-to-shaft connection elements define an opening configured to receive portions of a padlock that, when installed on the handle and housing assembly, obstructs, inhibits or prevents the handle from moving out of a retracted position; and, in some of these embodiments, housing-defined formations located near the periphery of the forwardly-facing recess of the housing also serve to prevent the retracted, padlocked handle from turning about the principal axis. The pad-lockability of the assembly may be used to supplement or to replace the action of a housing-carried key-operated lock that moves a lock bolt between locked and unlocked positions to selectively inhibit and permit turning of the shaft about the principal axis.

In some embodiments that employ "rear features" of the invention, a component such as a control member, a latch element or a latch operating element is connected to a rear portion of the handle-turnable shaft, and can be turned by the handle between first and second orientations. When in one or both of these orientations, the shaft-connected member may engage rearwardly-extending portions of the housing that serve to limit the permitted range of turning movement of the shaft-connected member, the shaft and the handle.

In some embodiments that employ "rear features" of the invention, a control member connected to a rear portion of the handle-turnable shaft has formations that permit the control member to be installed in different orientations on the shaft 1) so the handle can be turned about the principal axis in a selectable one of two opposite directions to cause the control member to pivot to a specific orientation, and/or 2) so the handle can be pivoted about the principal axis through different ranges turning movement as the handle turns the control member between the first and second orientations.

In some embodiments that employ "rear features" of the invention, spaced, rearwardly extending formations of the housing extend along opposite sides of a path of travel followed by a lock bolt as the lock bolt moves between locked and unlocked positions to guide the bolt as it moves along the path of travel. In some embodiments a pin or other element is provided to bridge between the spaced, rearwardly extending portions to engage the bolt to aid in guiding movements of the bolt along the path of travel.

In some embodiments that employ "rear features" of the invention, a latch element and/or a latch operating element may be connected to the shaft and/or to a shaft-carried control member to be turned between first and second orientations as the handle turns the shaft. If a latch element is connected to the shaft and/or to the control member, a cam formation constituting an element of the handle-to-shaft connection may serve to axially move the latch element forwardly or rearwardly to clamp or unclamp the latch element into or out of engagement with a strike or other structure to selectively retain a closure in a closed position. If a latch operating element is connected to the shaft and/or to the control member, one or more links may be connected to the control member to operate one or more remotely located latches in response to turning of the latch operating element by the handle.

In some embodiments that employ both "front features" and "rear features" of the invention, a handle and housing assembly is formed from a set of components that includes a housing which defines a forwardly facing recess, a retractable handle that can nest in the recess in each of a plurality of different orientations, and a shaft that extends through the housing along the principal axis. A front portion of the shaft is pivotally connected to the handle to enable the handle, while in any of the different orientations, to pivot from a retracted position nested in the recess to an extended position wherein the handle can be grasped to turn the shaft about the principal axis.

Also included among the components that are assembled to form a handle and housing assembly is a member that can be connected to the shaft to be turned by the shaft about the principal axis between first and second positions. Connection formations provided on the shaft and on the member can be assembled in a plurality of ways to accomplish one of two objectives, namely 1) to permit the handle to turn between a selection of pairs of the different handle orientations to cause the member to turn between the first and second positions, or 2) to permit the handle to turn in a chosen one of two opposite directions of rotation about the principal axis to turn the member to a chosen one of the first and second positions.

BRIEF DESCRIPTION OF THE DRAWINGS

These and other features, and a fuller understanding of the invention will be better understood in view of the description and claims that follow, taken together with the accompanying drawings, wherein:

DETAILED DESCRIPTION

As has been explained above, the present invention includes both "front features" and "rear features" that can be put to use separately; however, in preferred practice, front and rear features of the invention are advantageously combined.

Figure 1:
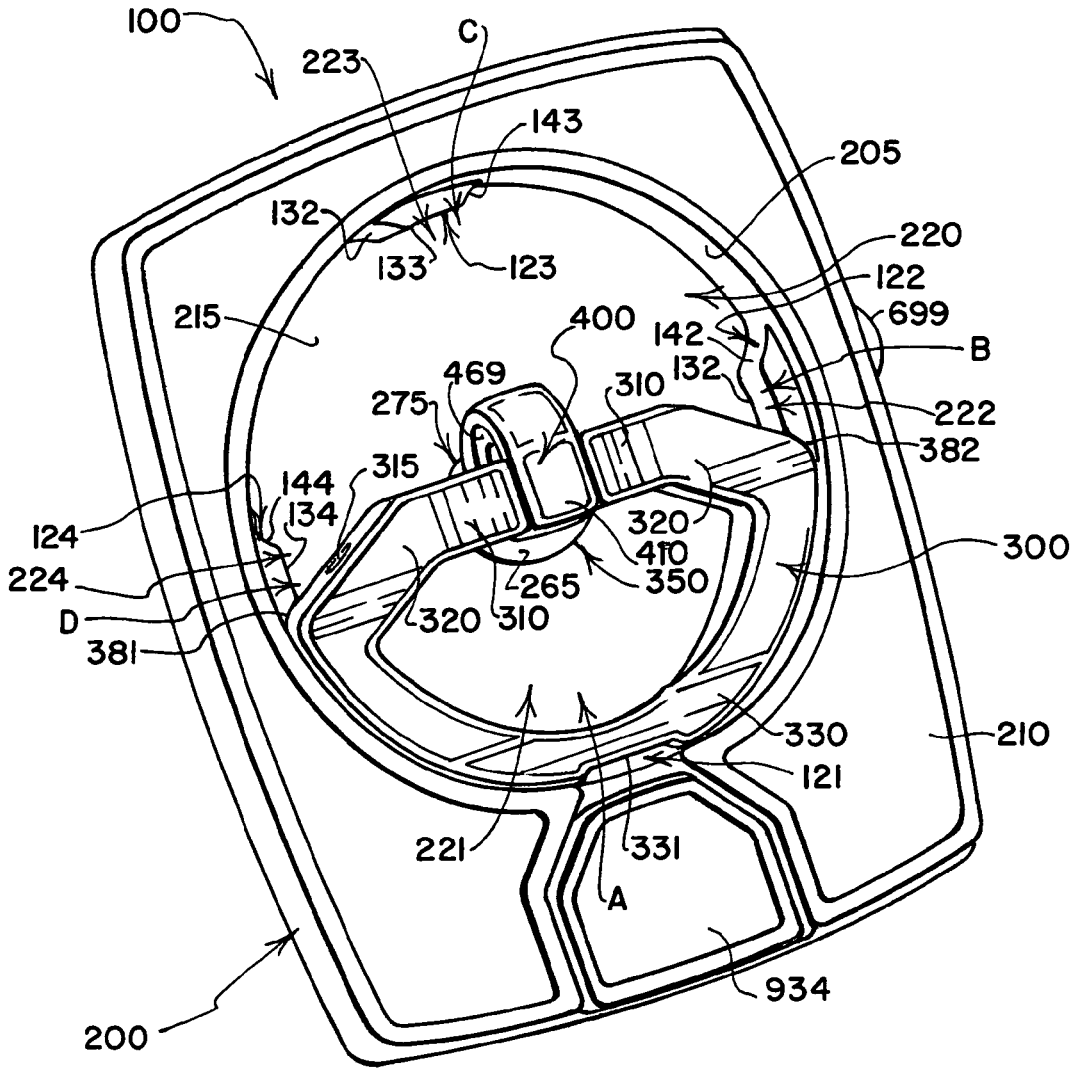
FIG. 1 is a perspective view showing mainly front portions of a handle and housing assembly with the handle in one possible nested position in the forwardly facing recess of the housing, and with a latch element turned to a latched position so that a portion of the latch element is seen extending rightwardly from behind the right side of the housing.
Figure 2:
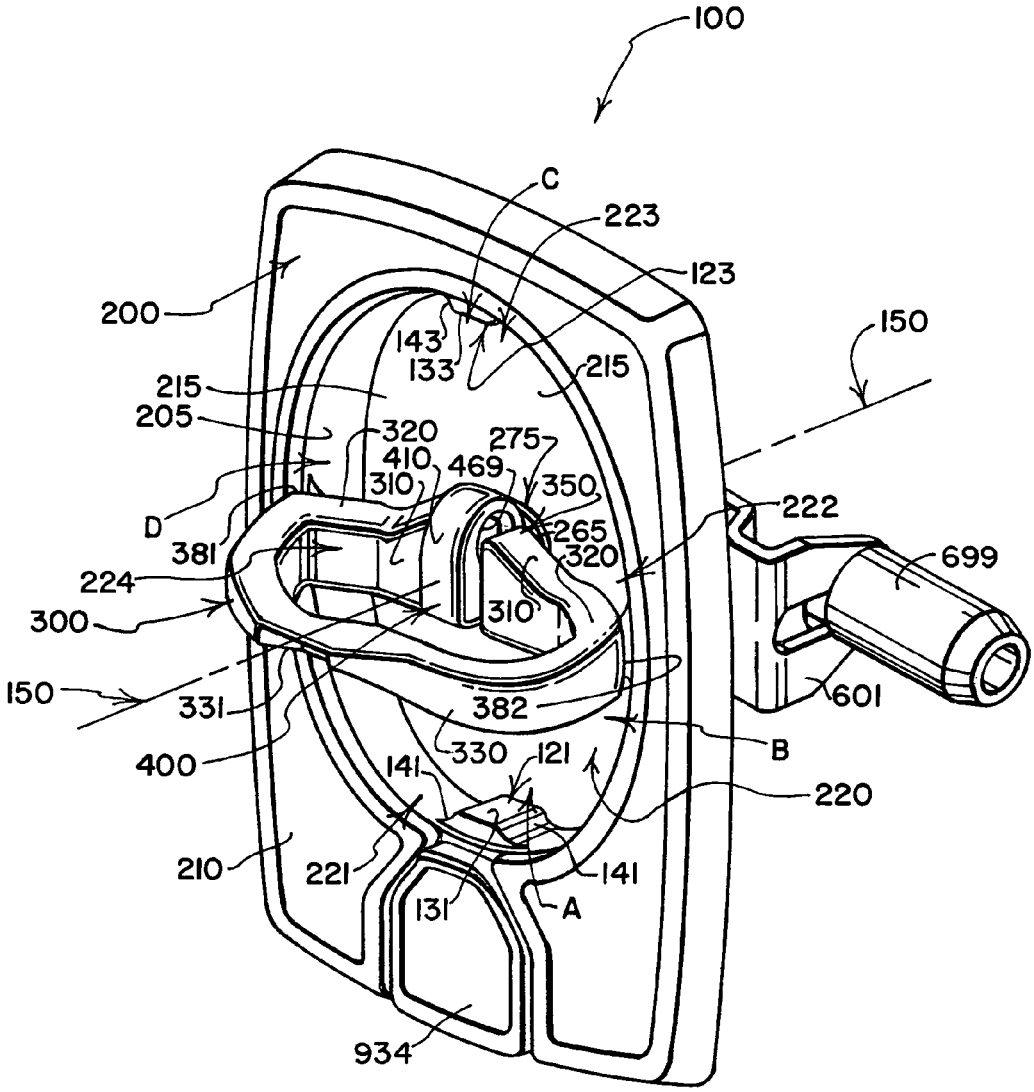
FIG. 2 is a perspective view again showing mainly front portions of the handle and housing assembly, but with the handle extended to project forwardly from the housing recess.

Referring to FIGS. 1 and 2, a handle and housing assembly embodying both "front features" and "rear features" of the invention is indicated generally by the numeral 100. The assembly includes a housing 200 of generally rectangular shape. A mounting flange 210 of the housing 200 surrounds a forwardly facing recess 220 defined by the housing 200.

Figure 5:
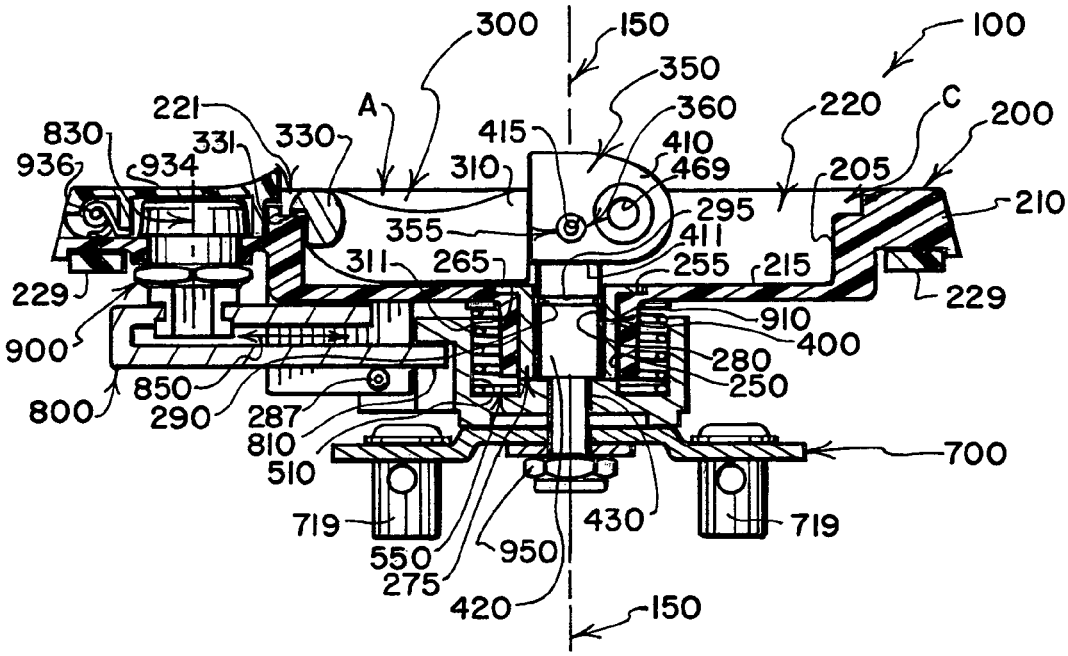
FIG. 5 is a sectional view as seen from a plane indicated by a line 5-5 in FIG. 3.
Figure 6:
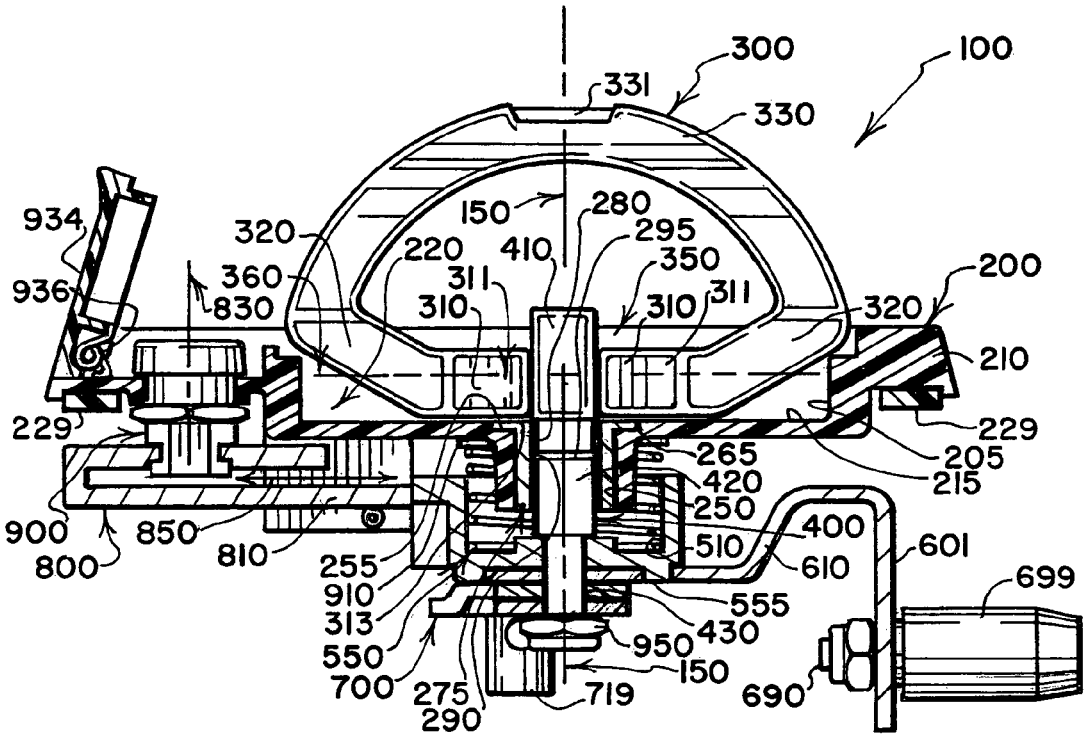
FIG. 6 is a sectional view as seen from a plane indicated by a line 6-6 in FIG. 4, but with a pivotal cover that normally conceals from view front portions of a lock mechanism pivoted upwardly to provide access to the lock mechanism's keyway.

An imaginary forwardly-rearwardly extending axis 150 is depicted in FIGS. 2, 5 and 6 as extending centrally through the recess 220. Because several of the features and components of the assembly 100 extend along, move along and/or turn about the axis 150, the axis 150 is referred to herein by the term "principal axis." Referring to FIGS. 5-7, a generally cylindrical sidewall 205 of the housing 200 extends concentrically about the axis 150 as does a housing-defined passage 250 which opens through the back wall 215.

Figure 3:
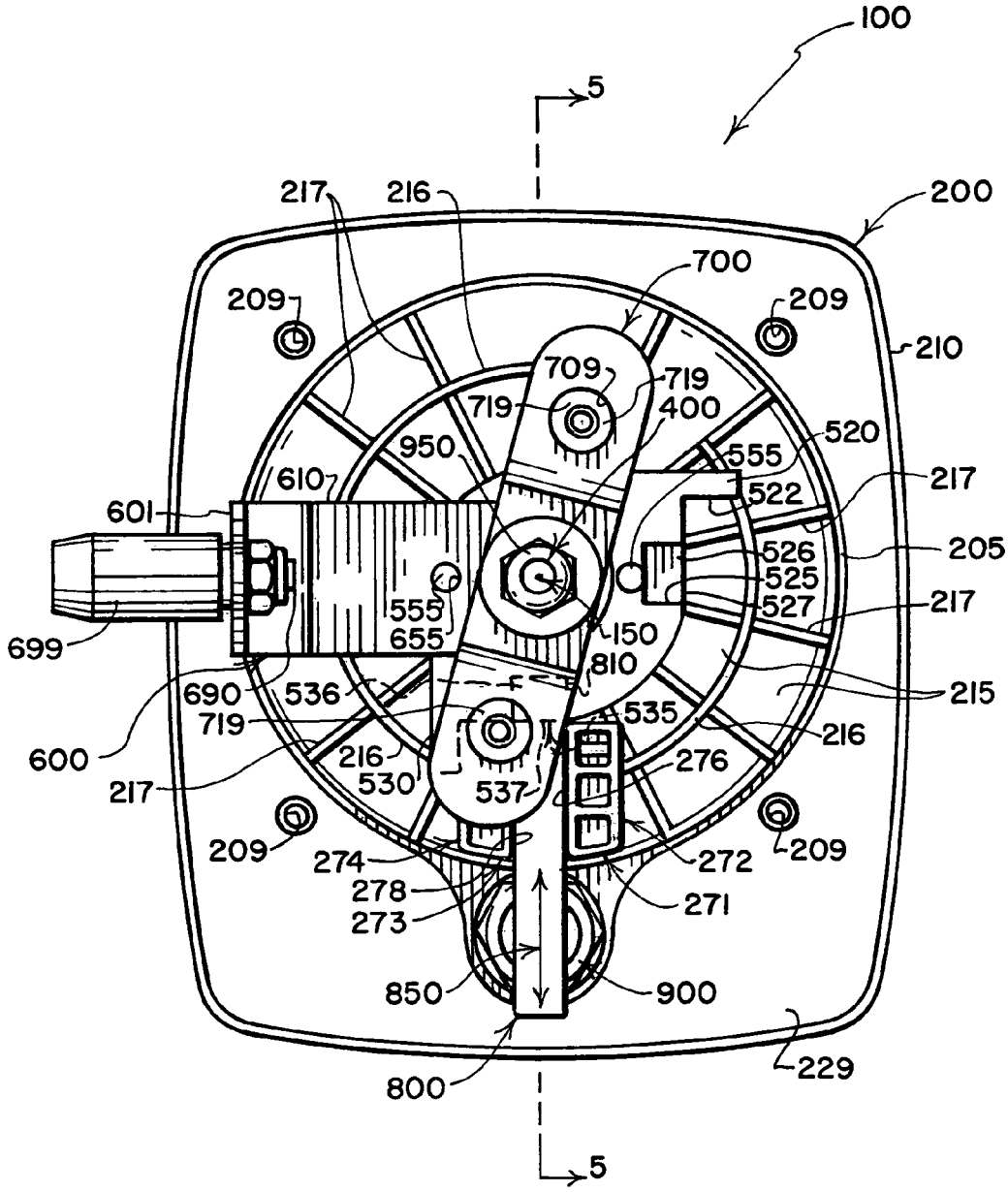
FIG. 3 is a rear view of the handle and housing assembly of FIGS. 1 and 2, with components thereof arranged as shown in FIG. 1, and with a lock bolt thereof in a locked position.
Figure 4:
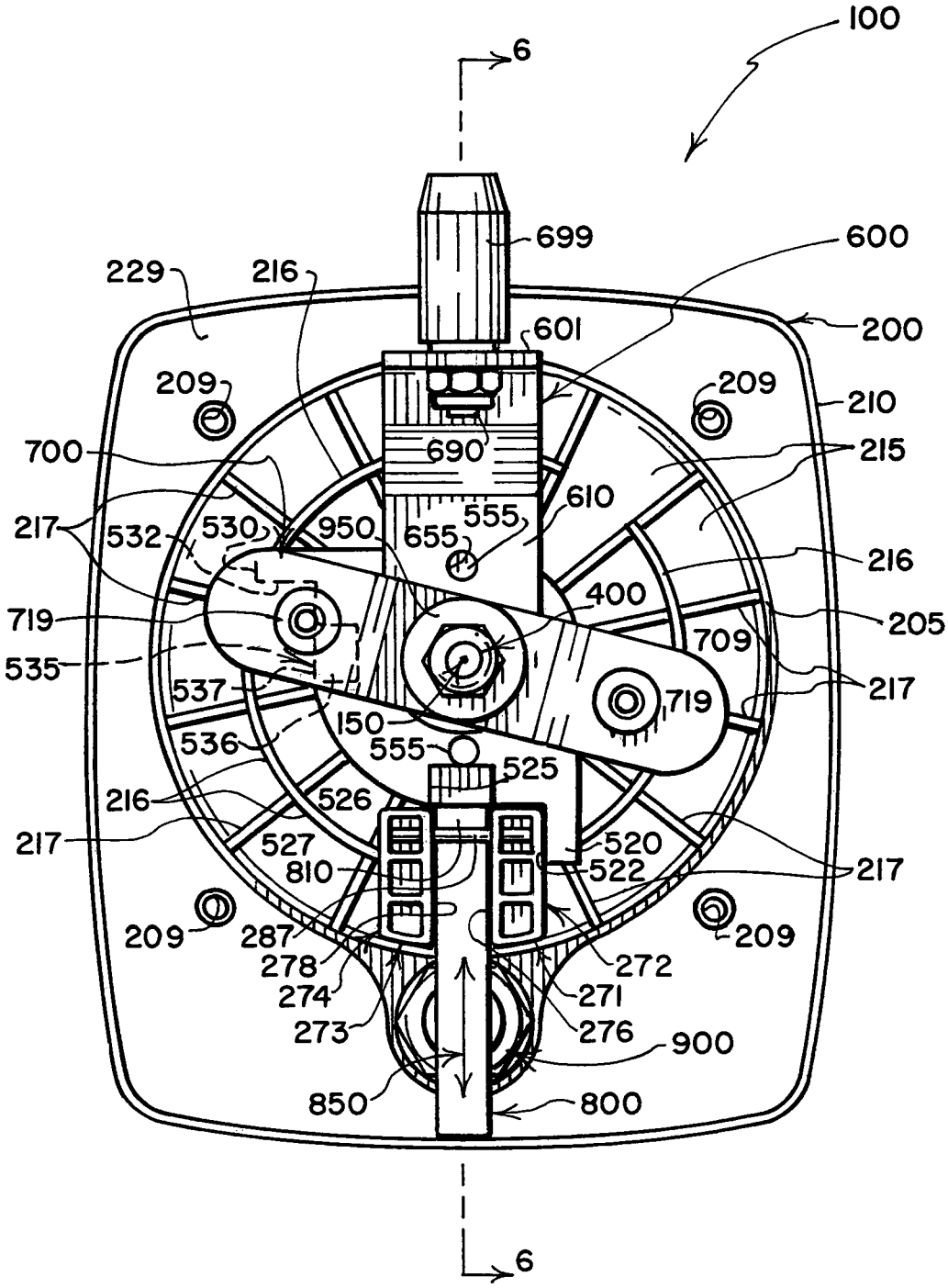
FIG. 4 is a rear view similar to FIG. 3 but with components arranged as they appear after the lock bolt has been moved to an unlocked position, and after the handle of the assembly has been turned a quarter-turn from the position shown in FIGS. 1-3 to position the latch element of the assembly in an unlatched position wherein a portion of the latch element is seen extending upwardly from behind a top portion of the housing.
Figure 7:
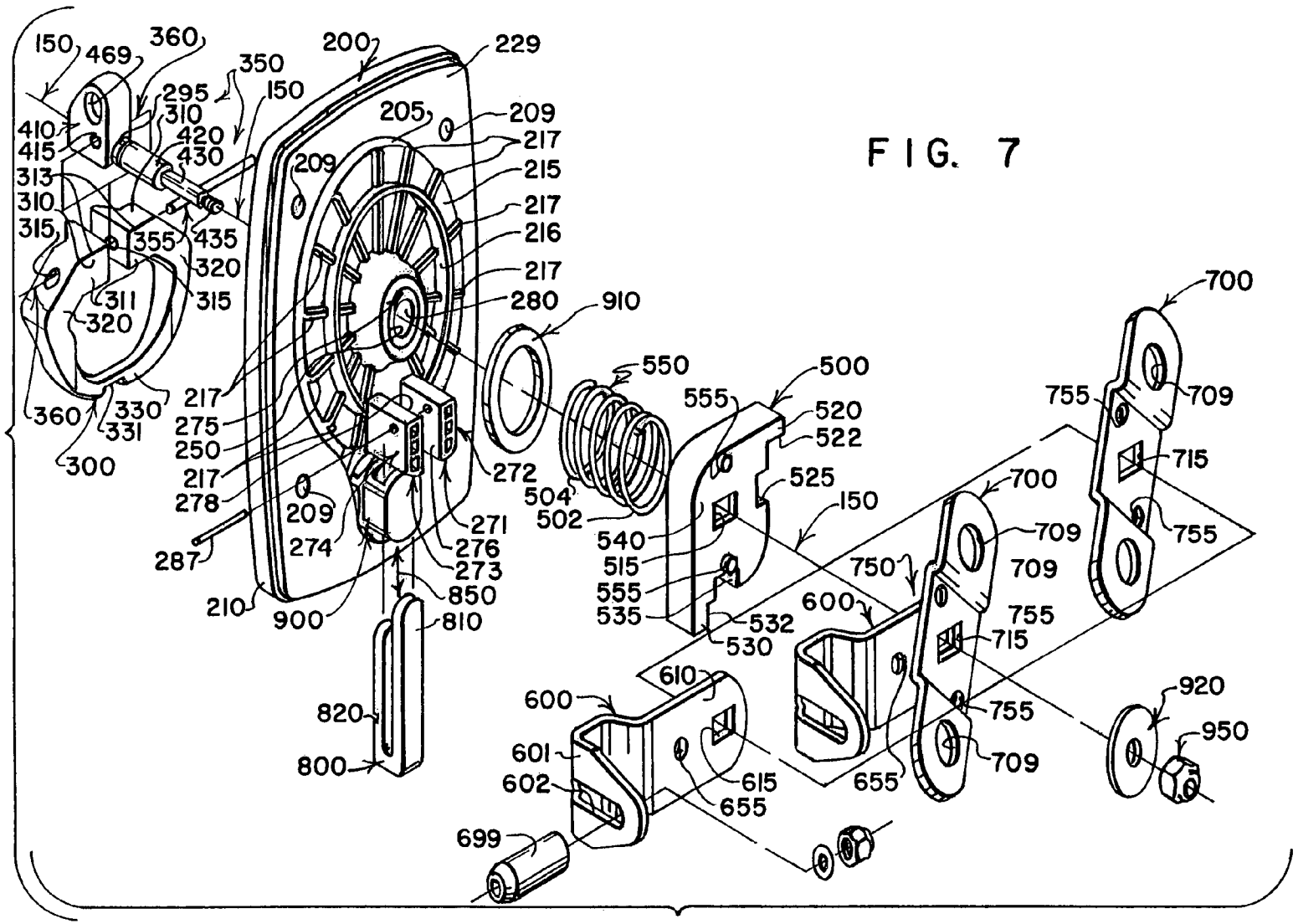
FIG. 7 is an exploded perspective view that permits features of components of the handle and housing assembly to be better seen.

Referring to FIGS. 3, 4 and 7, the back wall 215 is reinforced by a plurality of ribs, including a rib 216 that extends substantially concentrically about the principal axis 150, and ribs 217 that extend in a radial array about the principal axis 150. The ribs 216, 217 have been eliminated from the sectional views of FIGS. 5 and 6 so that other components of the assembly 100 can be viewed more clearly.

Referring to FIGS. 5 and 6, a front portion 255 of the housing-defined passage 250 is of relatively large diameter in comparison to a smaller, relatively uniform diameter of the remainder of the passage 250. A front flange 265 of a flanged bushing 275 is seated in the large diameter front portion 255 of the passage 250. A front surface of the flange 265 faces forwardly into the recess 220. A passage 280 that is concentric about the principal axis 150 extends through the bushing 275. Although the housing 100 may be formed from a variety of materials including, for example, die cast metal or injection molded plastic, the flanged bushing 275 preferably is formed from metal to resist wear and to strengthen central portions of the housing's back wall 215.

Figure 8:
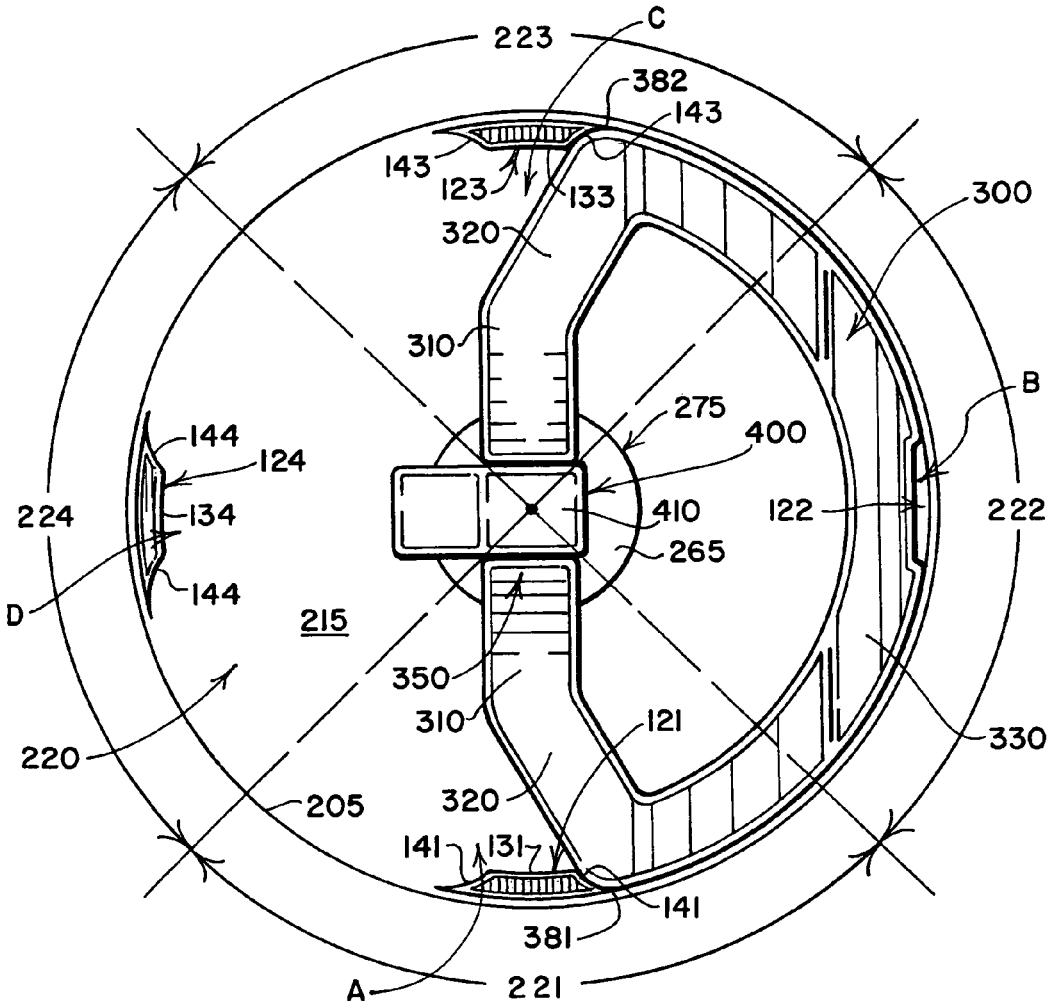
FIG. 8 is a front view of portions of the handle and housing assembly with the handle nested in the housing's forwardly facing recess in an orientation that corresponds to other components of the assembly being oriented as is depicted in FIGS. 4 and 6; and, FIG. 9 is a schematic depiction showing how the handle may be turned a quarter turn between any adjacent pair of four possible handle-nested positions that are permitted by the housing, and how these quarter movements of the handle may be utilized to turn a control member and/or a latch element, through a desired quarter-turn range of motion.

Referring to FIGS. 1, 2, 7 and 8, an ergonomically shaped, relatively complexly configured handle 300 is extensible from and nestable within various portions of the recess 220. The handle 300 pivots about an axis 360 (FIGS. 5-7) in moving between extended and retracted (i.e., nested) positions. Extended positions of the handle 300 are shown in FIGS. 2 and 6. Retracted positions of the handle 300 are shown in FIGS. 1, 5 and 8.

The handle 300 is a one-piece member, and preferably is formed from metal. Spaced base portions 310 of the handle 300 engage the front surface of the flange 265 of the bushing 275. A graspable, substantially C-shaped portion 330 of the handle 300 has its opposite end regions coupled by inclined portions 320 to the base portions 310.

Referring to FIGS. 1, 2 and 5-7, a handle-to-shaft connection 350 located centrally in the recess 220 couples the base portions 310 of the handle 300 to a relatively large front portion 410 of a shaft 400. Referring to FIGS. 5 and 7, a pivot pin 355 of the handle-to-shaft connection 350 extends through a hole 415 formed transversely through the front portion 410 of the shaft 400. Referring to FIG. 7, opposite end regions of the pivot pin 355 are received in holes 315 that are provided in the base portions 310 of the handle (one of the holes 315 also is visible in FIG. 1). A transversely extending axis 360 of the pivot pin 355 and of the aligned holes 315, 415 is indicated by the numeral 360 in FIGS. 6 and 7.

Referring to FIGS. 5-7, the shaft 400 has a generally cylindrical central portion 420 located just behind the relatively large front portion 410. The central portion 420 is received in a slip fit within the passage 250 of the flanged bushing 275. The slip fit of the central portion 420 in the bushing passage 280 permits the shaft 400 to turn about the principal axis 150 relative to the housing 200, and permits the shaft 400 to move forwardly and rearwardly along the principal axis 150 relative to the housing 200.

To minimize the passage of moisture, dust, dirt and other unwanted substances through the passage 280 of the bushing 275, an O-ring 290 is installed on the central portion 420 of the shaft 400. An outwardly opening groove 295 extends circumferentially about the central portion 420, and the O-ring 290 is nested in the groove 295.

Referring to FIG. 7, the central portion 420 of the shaft 400 couples the shaft's front portion 410 to a smaller rear portion 430 that is of substantially square cross-section. A very short rear end region 435 of the shaft 400 is threaded to enable a locknut 950 to be installed thereon.

Referring to FIG. 8, the forwardly facing recess 220 is made up of four substantially identically configured, pie-shaped segments or sectors 221, 222, 223 and 224. When the handle 300 is retracted to nest the graspable portion 330 in the recess 220 in the manner that is depicted in FIG. 1, the graspable portion 330 is caused to nest principally within the recess sector 221 in a handle nested position that is designated in FIGS. 1 and 8 by the letter "A."

To move the handle from the nested position "A" to an alternate handle nested position "B" (the position in which the handle is shown in FIG. 8), three handle movements are required. First, the handle 300 is turned about the axis 360 to the extended position of FIG. 2 wherein the graspable portion 330 projects forwardly from the recess 220 and can be grasped to turn the handle 300 about the principal axis 150. Second, the handle 300 is turned a quarter-turn about the principal axis 150 to the position of FIG. 6. Finally, the handle 300 is turned about the axis 360 to nest within the recess 220 in the handle nested position "B" as depicted in FIG. 8. When the handle 300 is in the nested position "B,", the graspable portion 330 of the handle 300 nests principally within the recess sector 222.

Figure 9:
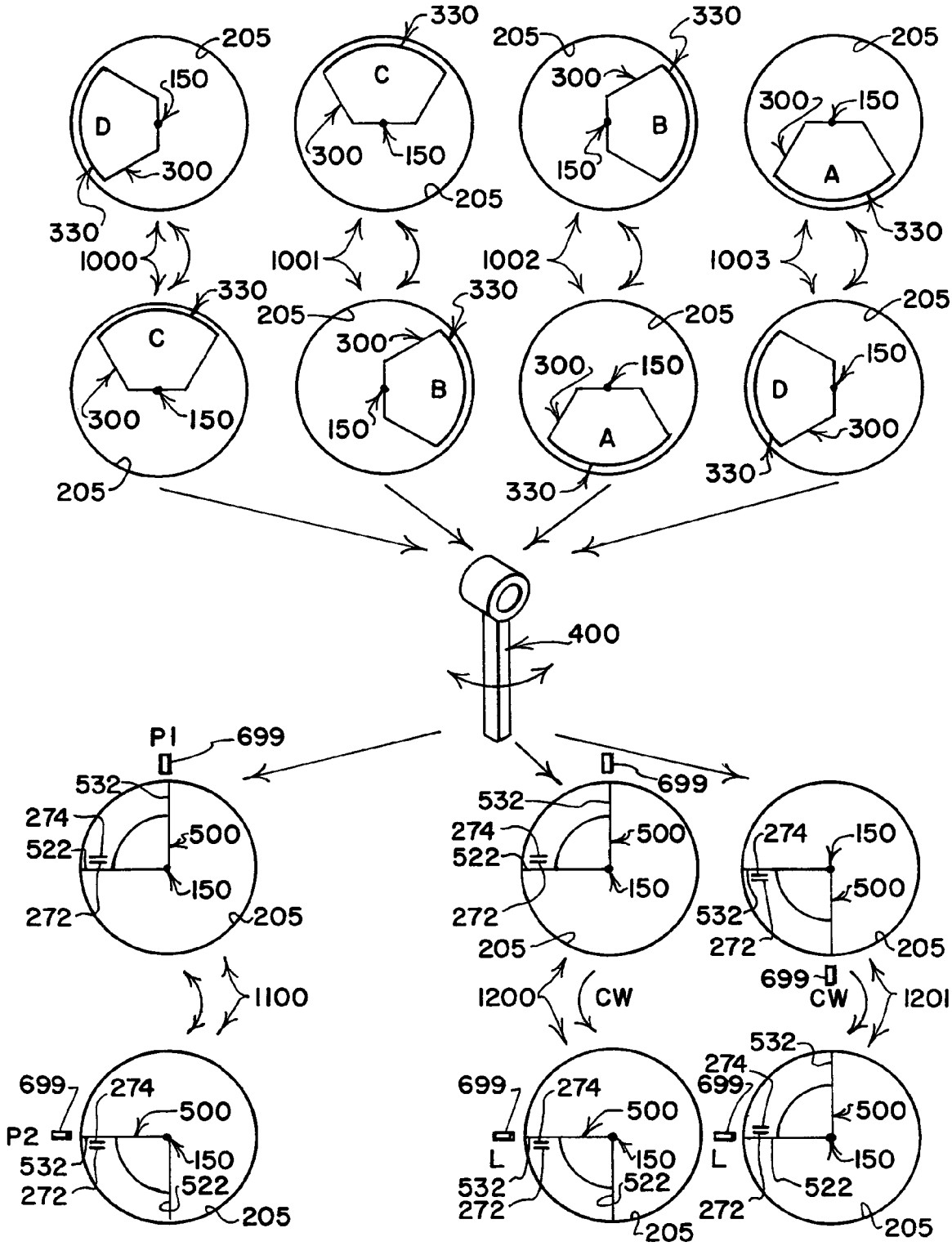

Discussed later herein in conjunction with the schematic depictions of FIG. 9 are two features of the preferred practice of the present invention, namely 1) that the recess 220 of the housing 200 is configured to permit the graspable portion 330 of the handle 300 to nest within any one of four handle nested locations that are identified in FIG. 8 by the letters "A," "B," "C" and "D;" and, 2) that the components of the assembly 100 can be arranged (i.e., assembled in a variety of ways) to permit the handle 300 to turn through one of four different quarter-turn ranges of motion (i.e., between any selected adjacent pair of the handle nested locations "A," "B," "C" and "D"—which is to say that the graspable portion 330 can nest within any of the recess sectors 221, 222, 223, 224 to provide any quarter-turn movement of the shaft 400 that is needed in order to turn through a desired quarter-turn of movement such components as may be connected to the rear portion 430 of the shaft 400).

Although the principal way in which the shaft 400 moves relative to the housing 200 involves turning of the shaft 400 about the principal axis 150, the shaft 400 also can move forwardly and rearwardly along the principal axis 150. Rearward movement of the shaft 400 along the axis 150 principally takes place as the result of the biasing action of a spring 550 that surrounds the shaft 400 at a location behind the back wall 215 of the housing 200 in a manner that will be described shortly. Forward movement of the shaft 400 along the axis 150 principally takes place in response to the handle 300 being pivoted from an extended position to a retracted position, or from a retracted position to an extended position.

To understand why the shaft 400 moves forwardly as the handle 300 is moved from an extended position to a retracted position (or vice versa), it is helpful to compare the positions of the handle 300 and the shaft 400 as these components are depicted in FIGS. 5 and 6. Referring to FIG. 6, it will be seen that, when the handle 300 is extended, a rearwardly facing surface 411 of the front portion 410 of the shaft 410 directly engages the front surface of the flange 265 of the bushing 275. However, when the handle 300 is retracted to the nested position of FIG. 5, it will be seen that the rearwardly facing surface 411 now is spaced forwardly (by a substantial distance) from the flange 265 of the bushing 275; thus, when the handle moves from an extended to a retracted position (i.e., to a "nested" position within the recess 220), the shaft 400 is forced to move forwardly.

What causes the shaft 400 to move forwardly along the principal axis 150 as the handle 300 pivots from an extended position to a nested position has to do with the configuration of surfaces 311 and corner regions 313 of the handle's base portions 310—features that are best seen in FIGS. 6 and 7. When the handle 300 is in an extended position (for example, as is depicted in FIG. 6), the surfaces 311 extend substantially vertically as seen in FIG. 6 (i.e., they substantially parallel to the principal axis 150). However, when the handle is pivoted to a retracted position, the surfaces 311 extend horizontally as seen in FIG. 5 (i.e., they substantially parallel the front face of the flange 265 of the bushing 275). As the surfaces 311 come into engagement with and are caused to rest flatly atop the front surface of the flange 265, the configuration of the base portions 310 (the elements of the handle 300 that define the surfaces 311) presses against the flange 265 in a way that causes the shaft 400 to move forwardly along the principal axis 150. Forward movement of the shaft 400 moves the surface 411 (defined by the front portion 410 of the shaft 400) out of engagement with the flange 265 so as to provide a sizable space between the surface 411 and the flange 265, as is depicted in FIG. 5.

As the shaft 400 is caused to move forwardly along the principal axis 150 due to pivoting of the handle 300 from an extended position to a retracted position, the slightly rounded corner formations 313 (defined by the base portions 310 of the handle 300, as best seen in FIGS. 6 and 7) engage the flange 265 in a camming sort of action that causes the shaft 400 to move forwardly to a maximum extent—a greater degree of forward movement of the shaft 400 than is depicted in FIG. 5 where the handle 300 is shown after it has been pivoted fully to a retracted position. As the corner formations 313 are brought into engagement with and slide briefly across portions of the front surface of the flange 265, the shaft 400 is forced as far forward as the shaft 400 ever travels due to pivoting of the handle 300 between extended and retracted positions (and vice versa). When the corner formations 313 no longer engage the flange 265 (because the surfaces 311 have come into seated engagement with the flange 265), the shaft 400 is not forced as far forwardly as it was when the corner formations 313 were cammingly engaging the flange 265.

Because the biasing action of the spring 550 opposes all forward movements of the handle 300 and all forward movements of the shaft 400, the camming action provided by the corner formations 313 (as described just above) causes the handle 300 to be biased toward a retracted position (as the handle 300 closely approaches a retracted position), and causes the handle 300 to be biased toward an extended position (as the handle closely approaches an extended position). What this means is that, as the handle 300 nears one of its retracted or one of its extended positions, the handle tends to move rather quickly toward, and then to remain seated in, the retracted or extended position that is being closely approached.

Stated in another way, because the corner formations 313 cause a maximum of forward movement of the shaft 400 (i.e., a maximum of compression of the spring 550) as the corner formations 313 pivot into a camming type of engagement with the flange 265 (during pivoting of the handle 300 about the axis 360), and because the camming engagement of the corner formations 313 with the flange 265 occurs at some mid point during pivotal movement of the handle 300 between its retracted and extended positions, the shaft 400 is most forcefully pulled rearwardly by the biasing action of the spring 550 when the corner formations 313 are being cammed against the flange 265. The strong biasing action of the spring 550 acting on the shaft 400 causes the handle 300 to move relatively quickly toward either a position where the surfaces 311 of the handle's base portions 310 engage the flange 265 (i.e., a nested position such as is depicted in FIG. 5) or a position where the surface 411 of the front part 410 of the shaft 400 engages the flange 265 (i.e., an extended position such as is depicted in FIG. 6).

Before turning to a detailed description of various other elements and features of the assembly 100, it is useful to pause here to briefly take inventory of other major components of the assembly 100 that may be connected to the housing 200 or to the shaft 400. For purposes of pointing out five of these major components, reference is made to FIG. 7. Three separate components that are designed to be drivingly coupled to (by being installed on the square cross-section of the shaft's rear portion 430) include a control member 500, a latch element 600 and a latch operating element 700. Two components that are designed to be mounted on the housing 200 include a lock bolt 800, and a locking mechanism 900. The locking mechanism can be used to move the lock bolt 800 along a path of travel (indicated in FIGS. 3-7 by the numeral 850) between a locked position depicted in FIGS. 3 and 5, and an unlocked position depicted in FIGS. 4 and 6.

Depicted in FIG. 7 at a location between the latch element 600 and the latch operating element 700 is a welded assembly 750 that provides a rigid combination of the elements 600, 700. The reason why the elements 600, 700 are shown individually and in welded combination in FIG. 7 is that, in many applications, only one of the elements 600, 700 may be needed, hence only one of the elements 600, 700 actually is mounted on the shaft 400. However, in other applications, both of the elements 600, 700 are needed and, to ensure that no unwanted relative movement takes place between the elements 600, 700, it is preferable in such applications to employ the welded assembly 750 instead of using the individual elements 600, 700. In still other applications, neither of the elements 600, 700 are needed, and neither are mounted on the shaft 400.

Also depicted in FIG. 7 are other components of the assembly 100 that are installed to extend circumferentially about portions of the shaft 400, namely the aforementioned spring 550 and two washers 910, 920. The washer 910 engages portions of the back wall 215 of the housing 200 and is, in turn, engaged by a front end region 504 of the spring 550. The washer 920 is installed on the shaft 400 just before the locknut 950 is threaded onto the shaft 400 and tightened in place.

Referring to FIGS. 5-7, the spring 550 has a rear end region 502 (see FIG. 7) that extends into a forwardly facing recess 510 of the control member 500. The spring 550 biases the control member 500, the latch element 600 and the latch operating element 700 (if these elements are installed on the shaft 400—or the welded assembly 750 if it is installed on the shaft 400) rearwardly to press against the washer 920. The effect of the biasing action of the spring 550 biasing some or all of the elements 500, 600, 700, 750 rearwardly to press against the washer 920 is to cause the washer 920 to press rearwardly on the locknut 950—which causes the entire shaft 400 to be biased rearwardly, and with it, the handle 300.

Referring to FIG. 7, the control member 500 has perpendicular extending engagement arms 520, 530 that give the control member 500 something of an L-shaped appearance. Stop engagement surfaces 522, 532 are defined by the arms 520, 530 and can engage one or more "stop" formations of the housing 200 to limit the permitted turning range of the control member 500, the shaft 400, the handle 300 and other components connected to the shaft 400 and/or to the control member 500, as is discussed later herein.

A rounded central region 540 of the control member 500 connects the arms 520, 530. A square opening 515 is formed centrally through the center region 540 and is sized to receive the square shaft portion 430 in a slip fit so the control member 500 can slide smoothly along the shaft portion 430 but is constrained to turn together with the shaft 400 about the principal axis 150.

Referring still to FIG. 7, a pair of cylindrical drive formations 555 are defined by the central region 540 at locations equally spaced from and on opposite sides of the principal axis 150. One or both of the drive formations 555 may be utilized to drivingly connect the control member 500 to one of the elements 600, 700, 750 by extending into a hole 655 that extends through the individual latch element 600, or into both of a pair of holes 755 that extends through the individual latch operating element 700, or into one or more of the holes 655, 755 of the welded assembly 750—but this is true only if one or more of the elements 600, 700, 750 are installed on the central portion 420 of the shaft 400 in a way that causes one or more of the holes 655, 755 to align with one or more of the cylindrical drive formations 555. If none of the drive formations 555 extends into any of the holes 655, 755, then turning movement of the elements 600, 700, 750 relative to the control member 500 is prevented only by the driving connection between the shaft 400 and each of the elements 500, 600, 700, 750 that is established when the elements 500, 600, 700, 750 are installed on the shaft 400 with their square openings 515, 615, 715 being drivingly engaged by the square central portion 420 of the shaft 400.

As is best seen in FIG. 7, a pair of notches 525, 535 are defined by the control member 500 at locations spaced short distances from where the stop engagement surfaces 522, 532 are defined by the control member 500. The notch 525 opens away from the principal axis 150 in a direction that parallels the length of the arm 520. The notch 535 opens away from the principal axis 150 in a direction that parallels the arm 530.

Referring still to FIG. 7, the stop engagement surfaces 522, 532 of the control member 500 are designed to engage stop formations of the housing 200 in order to limit the permitted range of turning movement of the control member 500 relative to the housing 200. By limiting the permitted range of turning movement of the control member 500, one also limits the permitting range of turning movement of the shaft 400, the handle 300, and such other components as may be drivingly connected to the shaft 400 and/or the control member 500 (for example the elements 600, 700, 750).

The housing 200 provides a pair of spaced-apart rearwardly extending formations 271, 273 that are located along opposite sides of the path of travel 850 of the lock bolt 800. Opposite sides of the formation 271 define a substantially flat stop surface 272 and a substantially flat guide surface 276. Opposite sides of the formation 273 define a substantially flat stop surface 274 and a substantially flat guide surface 278. The guide surfaces 272, 274 substantially parallel the path of travel 850 and are spaced apart by a distance that enables the guide surfaces 276, 278 to slidingly engage opposite sides of the lock bolt 800 in a slip fit to guide the lock bolt 800 as the lock bolt moves along the path of travel 850.

Bridging between the guide surfaces 276, 278 (i.e, between the formations 271, 273) is a bridging member that preferably takes the form of a roll pin 287 which has opposite ends that extend into aligned holes 289 defined by the formations 271, 273. The roll pin 287 preferably is positioned to engage a surface of the lock bolt 800 that is not engaged by the guide surfaces 276, 278, and cooperates with the guide surfaces 276, 278 to guide movements of the lock bolt 800 along the path of travel 850.

The stop surfaces 272, 274 serve to limit the permitted range of turning movement of the control member 500 because these surfaces are engaged by the stop engagement surfaces 522, 532 as the control member 500 moves to opposite ends of a permitted quarter-turn range of turning movement.

When the control member 500 has been turned about the principal axis 150 to a first position depicted in FIGS. 3, 5 and 7, the stop engagement surface 532 engages the stop surface 274; and, the notch 535 faces toward the path of travel 850 of the lock bolt 800 so that, if the shaft 400 and the control member have moved forwardly along the principal axis 150 due to the handle 300 being pivoted to the retracted position shown in FIG. 3, an inner end 810 of the lock bolt 800 can move along the path of travel 850 into the notch 535 to retain the control member 500 in the first position of FIGS. 3 and 7 (i.e., to prevent the control member 500, the shaft 400, the handle 300, and such other elements as may be drivingly connected to the shaft, for example one or more of the elements 600, 700, 750, from turning about the principal axis 150 to orientations other than is depicted in FIGS. 3, 5 and 7.

If, however, the handle 300 remains extended at a time when the control member notch 535 is aligned with the path of travel 850 of the lock bolt 800, the inner end region 810 of the lock bolt 800 will be prevented from entering the notch 535 by a wall 536 (shown by hidden lines in FIGS. 3 and 4) that closes a front side of the notch 535, because an outer edge 537 (shown by hidden lines in FIGS. 3 and 4) of the wall 536 will block the inner end region 810 from moving into the notch 535. Thus, the handle 300, the shaft 400, the control member 500 and such other elements as may be drivingly connected to the shaft 400 can only be retained in (i.e., locked in) the positions depicted in FIGS. 3, 5 and 7 if the handle 300 has been turned about the axis 360 of the handle-to-shaft connection 350 to nest within the recess 220 as is depicted in FIG. 3.

When the control member 500 has been turned about the principal axis 150 to a second position depicted in FIGS. 4 and 6, the stop engagement surface 522 engages the stop surface 272; and, the notch 525 faces toward the path of travel 850 of the lock bolt 800 so that, if the shaft 400 and the control member have moved forwardly along the principal axis 150 due to the handle 300 being pivoted to the retracted position, the inner end 810 of the lock bolt 800 can move along the path of travel 850 into the notch 525 to retain the control member 500 in the first position of FIGS. 4 and 6 (i.e., to prevent the control member 500, the shaft 400, the handle 300, and such other elements as may be drivingly connected to the shaft, for example one or more of the elements 600, 700, 750, from turning about the principal axis 150 to orientations other than is depicted in FIGS. 4 and 6.

If, however, the handle 300 remains extended at a time when the control member notch 525 is aligned with the path of travel 850 of the lock bolt 800, the inner end region 810 of the lock bolt 800 will be prevented from entering the notch 525 by a wall 526 that closes a front side of the notch 525 (in the same manner that the wall 536 closes a front side of the notch 536 as described above), because an outer edge 527 of the wall 526 will block the inner end region 810 from moving into the notch 525. Thus, the handle 300, the shaft 400, the control member 500 and such other elements as may be drivingly connected to the shaft 400 can only be retained in (i.e., locked in) the positions depicted in FIGS. 4 and 6 if the handle 300 has been turned about the axis 360 of the handle-to-shaft connection 350 to nest within the recess 220.

Referring to FIGS. 5 and 6, the locking mechanism 900 is a generally cylindrical assembly that is mounted in an opening 299 formed through the mounting flange 210 of the housing 200. As those skilled in the art will readily recognize, the locking mechanism 900 is a common "cam lock" assembly that, as is often the case with cam locks, includes an eccentric cam (not shown) that extends into a transversely extending notch 820 (see FIG. 7) of the lock bolt 800—an eccentric cam that, when turned about a center axis 830 of the locking mechanism 900 (best seen in FIGS. 5 and 6) causes the lock bolt 800 to translate along the path of travel 850 between locked and unlocked positions. How eccentric cams of conventional, commercially available cam locks are utilized to move lock bolts along a desired path of travel is well known to those who are skilled in the art and need not be described here in greater detail.

Referring to FIGS. 5 and 6, a locking mechanism cover 934 is pivotally connected to the mounting flange 210 of the housing 200, and is biased by a torsion spring 936 away from an open position shown in FIG. 6 to a closed position shown in FIG. 5. When the cover 934 is pivoted to the open position of FIG. 6, access is provided to front portions of the "cam lock" locking mechanism 900 so that a suitably configured key (not shown) can be inserted into a keyway (not shown) of the locking mechanism 900. When the inserted key is turned about the central axis 830 of the locking mechanism 900, the eccentric cam of the locking mechanism which extends into the slot 820 of the lock bolt 800 causes the lock bolt to move along the path of travel 850 toward or away from the principal axis 150 (i.e., toward or away from the control member 500) unless such movement of the lock bolt 800 along the path of travel 850 is prevented by some obstruction.

The depicted locking mechanism 900 is not an essential element of the handle and housing assembly 100 and can be omitted if a non-lockable version of the assembly is desired for a particular application. If the locking mechanism 900 is not what is wanted for use in a particular application, the locking mechanism 900 can be replaced by other commercially available cam lock products that are capable of moving other forms of lock bolts along the path of travel 850 to engage and disengage the notches 525, 535 of the control member 500 to retain the control member 500 in a selected one of the first and second positions described above. A patent assigned to The Eastern Company that discloses an alternate form of cam locking mechanism which moves a lock bolt along a path of travel and can be substituted for the lock bolt 800 and the locking mechanism 900 is the U.S. Pat. No. 6,513,353 discussed earlier herein, the disclosure of which is incorporated herein by reference.

Referring still to FIG. 7, the latch element 600 includes an elongate latch arm 610 that has the square opening 615 formed therethrough which is configured to receive the square shaft portion 430 in a slip fit so the arm 610 can slide smoothly along the shaft portion 430 but is constrained to turn together with the shaft 400 about the principal axis 150. A U-shaped end region 601 of the latch arm 610 is provided with a slot 602 to receive a threaded fastener 690 (see FIGS. 3 and 4) that adjustably connects a roller-type latch member 699 to the U-shaped end region 601 of the latch arm 610.

The roller-type latch member 699 can have its mounting position on the U-shaped end region 601 adjusted when the fastener 690 is loosened, whereafter the fastener 690 can be retightened to retain the latch member 699 in a position that enables the latch member 699 to engage a conventional latch strike (not shown) or other structure to retain in a closed position a closure (not shown) on which the assembly 100 is mounted.

The roller-type latch member 699 of the assembly 100 can be turned by the handle 300, when in an extended position, through a quarter-turn permitted range of turning movement about the principal axis 150. Because the latch arm 610 that carries the roller-type latch member 699 moves with the control member 500, the shaft 400, the handle 300 and such other elements as may be drivingly connected to the shaft 400, the permitted range of turning movement of the control member 500 determines the permitted range of turning movement of the roller-type latch element 699 between latched and unlatched positions.

Because the latch arm 610 can be installed on the square portion 430 of the shaft 400 in four different positions (namely 3 o'clock, 6 o'clock, 9 o'clock and 12 o'clock positions with respect to the housing 200), and because the handle 300 can turn the latch arm 610 between any adjacent pair of these four different positions as the handle 300 is turned through a quarter-turn of movement which is determined by how the control member 500 is installed on the share portion 430 of the shaft 400 (it being understood that the control member also can be installed on the shaft in any of the four different positions mentioned just above), the roller-type latch element 699 can be moved to any desired latch position (at 3 o'clock, 6 o'clock, 9 o'clock or 12 o'clock with respect to the housing 200) from any adjacent one of these four positions, or by turning the handle in either desired direction (clockwise or counterclockwise) about the principal axis 150.

The versatility that results 1) from providing a housing recess 220 that can nest the graspable portion 330 of the handle 300 principally within any of the four handle nested positions "A," "B," "C" and "D" depicted in FIGS. 1, 2 and 8; 2) from providing a control member 500 that can be installed on the shaft 400 in a various orientations; and 3) from providing a latch element 600 that can be installed on the shaft 400 to cause the "latched" position of a latch member 699 to take any desired one of four positions (such as 3 o'clock, 6 o'clock, 9 o'clock or 12 o'clock relative to the housing 200) is schematically depicted in FIG. 9.

What is schematically depicted by a portion of FIG. 9 that is designated by the numeral 1002 is the quarter-turn movement capability of the handle 300 that has been discussed earlier herein, namely the quarter-turn movement that is involved in reorienting the handle 300 from being nestable within one of the handle nested positions "A" and "B" to being nestable within the other of the handle nested positions "A" and "B." Such a quarter-turn movement of the handle 300 is transmitted by the shaft 400 (depicted near the center of FIGS. 9 and 10) to the control member 500 which is shown in various orientations on bottom portions of FIG. 9.

What also is depicted in FIG. 9 is that other quarter turn movements of the handle 300 between other adjacent pairs of the handle nesting positions "A," "B," "C" and "D" also can be utilized to effect quarter-turn shaft movements that cause quarter-turn movements of the shaft-connected element 500. For example, the numeral 1000 designates quarter-turn handle movements between the handle nesting positions "C" and "D;" the numeral 1001 designates quarter-turn handle movements between the handle nesting positions "B" and "C;" and, the numeral 1003 designates quarter-turn handle movements between the handle nesting positions "A" and "C"—all of which can be utilized to cause quarter-turn movements of the shaft 400 which, in turn, causes the control member 500 to execute a quarter-turn movement.

In a lower portion of FIG. 9, what is depicted by the numeral 1100 are quarter-turn movements of the control member 500 that can move the latch member 699 from a first position labeled "P1" (perhaps an "unlatched position" of the latch member 699) to a second position labeled "P2" (perhaps a "latched position" of the latch member 699). Any of the quarter-turn handle movements designated in upper portions of FIG. 9 by the numerals 1000, 1001, 1002, 1003 can be utilized to effect the quarter-turn movements of the control member 500 and the quarter-turn reorientations of the latch member 699 that are designated in a lower portion of FIG. 9 by the numeral 1100.

Also shown in lower portions of FIG. 9 are quarter-turn counterclockwise and clockwise movements of the control member 500 that can be utilized to move the latch member 699 to a "latched" position that is designated by the letter "L." A counterclockwise quarter-turn movement of the control member 500 that brings the latch member 699 to a desired latched position "L" is designated by the numeral 1200. A clockwise quarter-turn movement of the control member 500 that brings the latch member 699 to the desired latched position "L" is designated by the numeral 1201. Either of the quarter-turn movements (one requiring that the shaft 400 turn in one direction about the principal axis 150, and the other requiring that the shaft 400 turn in the opposite direction about the principal axis 150) can be effected by turning the handle 300 through quarter-turn movements that are designated by the numerals 1000, 1001, 1002, 1003 on upper portions of FIG. 9.

Thus, as will be clear to those who are skilled in the art, the versatile ways in which the components of the assembly 100 can be arranged (i.e., assembled) permits one to select such features of the assembly 100 as: which pair of adjacent handle nested positions "A," "B," "C" and "D" are to be utilized to cause any desired quarter-turn movement of the shaft 400 that may be needed to turn the control member 500 between the first and second positions that bring the stop engagement surfaces 522, 532 into engagement with the housing-defined stop surfaces 272, 274; which of four possible "latched" orientations is to be utilized by the latch member 699; and, which of two possible directions of rotation about the principal axis 150 are to be utilized by the shaft 400 in turning the latch member 499 to its selected "latched" position (i.e., clockwise or counterclockwise).

Because the latch member 699 moves forwardly and rearwardly with the latch element 600, the control member 500 and other shaft-connected elements as the shaft 400 is caused to move forwardly and rearwardly as the result of pivoting of the handle 300 between extended and retracted positions (as has been described in detail above), the retraction of the handle 300 to a retracted or nested position within the recess 220 of the housing 200 can be utilized to move the latch member 699 forwardly into clamping engagement with a latch strike or other structure that is to be engaged by the latch member 699 when the latch member 699 is in its latched position. Stated in another way, the forward movement of the latch member 699 that results when the handle 300 is pivoted to a retracted position about the axis 360 of the handle-to-shaft connection 350 gives the assembly 100 the capability to serve as a so-called "compression latch" that not only prevents a closure from opening when "latched," but also clamps the closure in its closed position to prevent rattling and other unwanted movement of the closure in the presence of vibration.

When the assembly 100 is to be mounted on a closure or other support structure (not shown), an opening is formed through the closure or other support structure—an opening of sufficient size to permit the cylindrical outer sidewall 205 (that surrounds the recess 220) and other portions of the assembly associated with the lock bolt 800 and the locking mechanism 900 to pass therethrough. The mounting flange 210 is then securely connected to the closure or other support structure, typically by threaded fasteners (not shown) that extend into threaded, rearwardly facing openings 209 of the mounting flange 210 (see FIGS. 3 and 4).

Referring to FIGS. 3-7, a resilient gasket 229 adhered to a back surface of the mounting flange 210 is clamped between the mounting flange 210 and the closure or other support structure on which the assembly 100 is mounted—usually by tightening the aforementioned fasteners (not shown) into the threaded openings 209.

Referring to FIGS. 1 and 7, an opening 469 is formed through the front portion 410 of the shaft 400 to permit a padlock (not shown) to be installed on the front portion 410 of the shaft 400 when the handle 300 is in a retracted position. When a padlock portion, such as a shank of a padlock, is inserted through the opening 469, the base portions 310 of the handle 300 cannot move across the opening 469, hence the handle 300 is blocked from pivoting to an extended position.

Referring to FIGS. 1, 2 and 8 wherein selected ones of the following features can be seen, four substantially identical handle engagement formations 121, 122, 123, 124 of the housing 200 are provided at 3 o'clock, 6 o'clock, 9 o'clock and 12 o'clock locations along the sidewall 205. The handle engagement formations 121, 122, 123, 124 have identically curved inner surface portions 131, 132, 133, 134 that face toward the principal axis 150. Opposite ends of the curved inner surface portions 131, 132, 133, 134 are joined by identically curved surfaces 141, 142, 143, 144 to the sidewall 205. To the extent that some of the curved surfaces just mentioned are not readily visible in the drawings, the fact that others are shown, and the identical nature of these surfaces, will enable the reader to understand their location and configuration.

When the handle 300 is pivoted about the axis 360 of the handle-to-shaft connection 350 to bring the graspable portion 330 of the handle 300 to a position where it nests principally within one of the recess sectors 221, 222, 223, 224, one of the handle engagement formations 121, 122, 123, 124 (the one that is associated with the recess sector 221, 222, 223, 224 within which the graspable portion 330 of the handle 300 is being nested) extends toward the graspable portion 330 of the handle 300 and preferably extends into depression 331 that is defined by the graspable handle portion 330 (see FIGS. 2, 5 and 7). If the handle 330 is moved far enough into the recess 220 when pivoted to a retracted position, the handle engagement formation that extends into the depression 331 will engage and support the nested handle 300.

When the handle 300 is in one of its retracted positions (i.e., one of its handle nested positions "A," "B," "C" or "D"), curved portions of the handle 300 that are designated by the numerals 381, 382 in FIGS. 1 and 8 extend closely alongside adjacent ones of the curved surfaces 141, 142, 143, 144 of the handle engagement formations 121, 122, 123, 124 in a way that obstructs turning of the nested handle 300 about the principal axis 150. One or more of the curved surfaces 141, 142, 143, 144 may, in fact, engage the curved handle portions 381, 382 to prevent turning of the retracted handle 300 about the principal axis 150 when the handle 300 is in the handle nested positions "A," "B", "C", and "D."

Referring to FIGS. 1, 2 and 5-7, a cover 934 is pivotally connected to the mounting flange 210 of the housing 200, and is biased by a spring 936 (FIGS. 5 and 6) to a position wherein the cover 934 protectively overlies and hides from view front portions of the locking mechanism 900. As is seen in FIG. 6, the cover 934 may pivot to a position that provides access to front portions of the locking mechanism 900 to enable a key (not shown) to be inserted into and turned within a keyway (not shown) of the locking mechanism 900.

Referring to FIG. 7, holes 709 are formed through opposite end regions of the latch operating element 700. Referring to FIGS. 3-6, connection elements 719 may be installed in the holes 709 to permit rod-like links (not shown) to be pivotally connected to the latch operating element 700 for operating remotely located latches (not shown) in response to turning of the latch operating element 700 about the principal axis 150 as the result of the handle 300 being turned about the principal axis 150. How connection elements such as those designated by the numerals 719 can be utilized to connect with rod-like links to operate remotely located latches in response to the turning of a latch operating element is well known to those who are skilled in the art, and is disclosed in greater detail in patents assigned to The Eastern Company, including U.S. Pat. No. 6,755,449 issued Jun. 29, 2004 to Weinerman et al and U.S. Pat. No. 6,543,821 issued Apr. 8, 2003 to Weinerman et al, the disclosures of which are incorporated herein by reference.

As will be apparent from the foregoing description taken together with the accompanying drawings and the claims that follow, the present invention provides a handle and housing assembly with a housing that may define a forwardly-facing recess that is configured to permit a retractable handle to nest within various portions of the recess in different orientations—orientations that can be selected for use in different applications so the housing can be oriented as desired, and so the handle can turn between desired orientations as it is used to turn a variety of shaft-connected components. In preferred practice, housing-defined stops located on the rear side of the housing not only interact with a shaft-carried control member, but also serve to guide movements of a lock bolt along a path of travel between locked and unlocked positions. And, in preferred practice, the fact that a control member and other shaft-connectable components can be installed on the handle-turned shaft of the assembly in different orientations permits substantially any desired quarter-turn movement of the handle to be utilized to turn the shaft-connected components through desired quarter-turn ranges of movements by rotating the shaft in either of two possible directions.

Although features of the invention have been described in terms of quarter-turn movements of various components, and although the housing recess has been described as being divided into four quadrant-like sectors to define four handle nested positions, those who are skilled in the art will recognize that features of the present invention are not limited to applications that involve "quarter-turn" movements, or to housing recesses that define "four" handle nested positions, or to other features that are quadrant related. Features of the invention can be used with handle and housing assemblies that use more or less than "four" of each of the features that have been described as being provided in quantities of "four."

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the patent shall cover by suitable expression in the appended claims whatever features of patentable novelty exist in the invention disclosed.

What is claimed is:

1. A handle and housing assembly, comprising:

a) a housing having a front side and a rear side, and defining a forwardly facing recess of circular shape formed by four contiguously extending pie-shaped, quadrant-like recess sectors arrayed about a forwardly-rearwardly extending principal axis that intersects a center point of the circular recess;

b) a shaft extending along the principal axis through the housing and turnable about the principal axis;

c) a handle i) sized and shaped to be nestable within the circular recess in each of four orientations where, when nested, the handle overlies central parts of different ones of the four recess sectors, and ii) pivotally connected to the shaft at a central location within the recess on the front side of the housing by a handle-to-shaft connection that permits the handle to pivot relative to the shaft between positions nested in the recess wherein the handle overlies a central part of different ones of the recess sectors, and positions extended forwardly from the recess wherein the handle is graspable to turn the shaft about the principal axis;

d) a control member on the rear side of the housing coupled to the shaft by a member-to-shaft connection that permits the control member to turn about the principal axis to and from a specific orientation; and, e) wherein the member-to-shaft connection has engageable formations that can be assembled in a first way which requires the handle to turn in one direction about the principal axis when turning the control member to the specific orientation, and in a second way that requires the handle to turn in an opposite direction about the principal axis when turning the control member to the specific orientation.

2. The assembly of claim 1 further comprising a housing-connected handle engagement formation configured to engage the handle when nested in the recess to inhibit turning of the handle about the principal axis.

3. The assembly of claim 1 further comprising a housing-connected handle engagement formation configured to engage the handle when nested in the recess to support the handle when nested in the recess.

4. The assembly of claim 1 further comprising a housing-connected handle engagement formation configured to engage the handle to inhibit turning of the handle about the principal axis when the handle is nested in the recess.

5. The assembly of claim 1 further comprising first and second housing-connected handle engagement formations configured to engage spaced portions of the handle to inhibit turning of the handle about the principal axis when the handle is nested in the recess.

6. The assembly of claim 1 further comprising a padlock-engageable formation defined by a selected one of the shaft and the handles and configured to be engaged by a padlock to prevent the handle from being moved from any of said positions nested in the recess.

7. The assembly of claim 1 wherein the handle-to-shaft connection includes a cam formation configured to cause movement of the shaft along the principal axis as the handle is moved between said positions nested in the recess and said positions extended forwardly from the recess.

8. The assembly of claim 7 further comprising a spring that cooperates with the cam formation to cause the handle to be biased toward said positions extended forwardly from the recess when the handle is moved toward and closely approaches said positions extended forwardly from the recess, and to cause the handle to be biased toward said positions nested in the recess when the handle is moved toward and closely approaches said positions nested in the recess.

9. The assembly of claim 1 further comprising a lock bolt on the rear side of the housing movable along a path of travel between an unlocked position and a locked position, wherein the lock bolt is configured to retain the control member in the specific orientation if the control member is in the specific orientation when the lock bolt is moved to the locked position.

10. The assembly of claim 9 further comprising a rear portion of the housing configured to extend at spaced locations along opposite sides of the path of travel to guide movements of the lock bolt along the path of travel.

11. The assembly of claim 10 further comprising a bridging member connected to the rear portion of the housing and bridging between the spaced locations to guide movements of the lock bolt along the path of travel.

12. The assembly of claim 11 wherein the bridging member is a roll pin having end regions that extend into aligned passages defined by parts of the bridging member situated on opposite sides of the path of travel, and having a central region positioned to engage the lock bolt as the lock bolt moves along the path of travel.

13. The assembly of claim 10 wherein the rear portion of the housing defines at least one stop formation that is engaged by the control member when the control is turned to the specific orientation.

14. The assembly of claim 1 further comprising a stop formation defined by the housing and configured to be engaged by the control member when the control member is turned to the specific orientation.

15. The assembly of claim 1 further comprising a latch element connected to a selected one of the shaft and the control member to be turned together with the handle, the shaft and the control member about the principal axis.

16. The assembly of claim 10 further comprising a cam formation defined by a selected one of the handle and the shaft to cause forward movement of the shaft along the principal axis in response to movement of the handle away from said positions extending forwardly from the recess, and wherein said forward movement of the shaft causes forward movement of the latch element.

17. The assembly of claim 1 further comprising a latch operating element connected to a selected one of the shaft and the control member to be turned together with the handle, the shaft and the control member about the principal axis, wherein the control member defines at least one link connection formation that is caused to move relative to the housing as the handle is turned about the principal axis.

18. A handle and housing assembly, comprising:

a) a housing having a front side and a rear side and defining a forwardly facing recess of circular shape formed by four contiguously extending pie-shaped, quadrant-like recess sectors arrayed about a forwardly-rearwardly extending principal axis that intersects a center point of the circular recess;

b) a shaft extending along the principal axis through the housing and turnable relative to the housing about the principal axis;

c) a handle on the front side of the housing i) sized and shaped to be nestable within the circular recess in each of four orientations where, when nested, the handle overlies central parts of different ones of the four recess sectors, and ii) pivotally coupled to the shaft by a handle-to-shaft connection that permits the handle to pivot relative to the shaft between positions extending forwardly from the recess wherein the handle can be grasped and turned to turn the shaft about the principal axis, and to pivot rearwardly toward the housing to positions nested in the recess overlying central parts of different ones of the recess sectors when not being grasped to turn the shaft;

d) a control member on the rear side of the housing coupled by a member-to-shaft connection that permits the control member to turn about the principal axis together with the shaft between a first orientation and a second orientation in response to turning of the handle and shaft about the principal axis; and, e) wherein a selected one of the handle-to-shaft and the member-to-shaft connections includes formations that can be assembled in a first way to enable the handle to turn about the principal axis through a first range of motion to cause movement of the control member from the first orientation to the second orientation, and in a second way to enable the handle to turn about the principal axis through a second range of motion to cause movement of the control member from the first orientation to the second orientation.

19. The assembly of claim 18 further comprising a housing-connected handle engagement formation configured to engage the handle when nested to inhibit turning of the nested handle about the principal axis.

20. The assembly of claim 18 further comprising at least two housing-connected handle engagement formations configured to engage spaced surfaces of the handle when nested to prevent turning of the handle about the principal axis.

21. The assembly of claim 18 further comprising a padlock-engageable formation defined by a selected one of the shaft and the handle at a location near the handle-to-shaft connection and configured to be engaged by a padlock to prevent the handle from being moved to said positions extending forwardly from the recess.

22. The assembly of claim 18 wherein the handle-to-shaft connection incorporates a cam formation configured to cause movement of the shaft along the principal axis as the handle is moved to and from said positions extending forwardly from the recess.

23. The assembly of claim 22 further comprising a spring biasing the shaft rearwardly along the principal axis, and wherein the cam formation and the spring cooperate to cause the handle to be biased toward said positions extending forwardly from the recess as the handle is moved toward and closely approaches said positions extending forwardly from the recess, and to be biased toward the housing as the handle moves rearwardly toward said positions nested in the recess.

24. The assembly of claim 18 further comprising a lock bolt on the rear side of the housing movable along a path of travel between an unlocked position and a locked position engaging the control member when the control member is in a selected one of the first orientation and the second orientation to prevent the control member from moving out of the selected one of the first orientation and the second orientation.

25. The assembly of claim 24 further comprising a rear portion of the housing configured to extend at spaced locations along opposite sides of the path of travel to guide movements of the lock bolt along the path of travel.

26. The assembly of claim 25 further comprising a bridging member connected to the rear portion of the housing and bridging between the spaced locations to guide movements of the lock bolt along the path of travel.

27. The assembly of claim 26 wherein bridging member is a roll pin having end regions that extend into aligned passages defined by parts of the bridging member situated on opposite sides of the path of travel, and having a central region positioned to engage the lock bolt as the lock bolt moves along the path of travel.

28. The assembly of claim 25 wherein the rear portion of the housing defines at least one stop formation that is engaged by the control member when the control member is in a chosen one of the first orientation and the second orientation.

29. The assembly of claim 18 further comprising a stop formation defined by the housing and configured to be engaged by the control member when in a selected one of the first orientation and the second orientation.

30. The assembly of claim 18 further comprising a latch element connected to a selected one of the shaft and the control member to be turned together with the handle, the shaft and the control member about the principal axis.

31. A handle and housing assembly, comprising:

a) a housing having a front side and a rear side, and defining a forwardly facing recess of circular shape formed by four contiguously extending pie-shaped, quadrant-like recess sectors arrayed about a forwardly-rearwardly extending principal axis that intersects a center point of the circular recess;

b) a shaft extending along the principal axis through the housing and turnable about the principal axis;

c) a handle i) sized and shaped to be nestable within the circular recess in each of four orientations where, when nested, the handle overlies central parts of different ones of the four recess sectors, and ii) pivotally connected to the shaft at a central location within the recess on the front side of the housing by a handle-to-shaft connection that permits the handle to pivot relative to the shaft between positions nested in the recess wherein the handle overlies a central part of different ones of the recess sectors, and positions extended forwardly from the recess wherein the handle is graspable to turn the shaft about the principal axis;

d) a member on the rear side of the housing coupled to the shaft by a member-to-shaft connection that permits the member to be turned by the shaft between a first orientation and a second orientation in response to turning of the shaft by the handle, wherein the member-to-shaft connection has engageable formations that can be assembled in a first way which enables the handle and shaft to turn in one direction when turning the member from the first orientation to the second orientation, and in a second way which enables the handle and shaft to turn in an opposite direction when turning the member from the first orientation to the second orientation;

e) a lock bolt connected to the housing for movement along a path of travel to and from a locked position wherein the lock bolt engages the member to prevent turning about the principal axis of the member, the shaft and the handle; and, f) a formation connected to the rear side of the housing having a first portion configured to be engaged by the member to limit turning movement of the member about the principal axis when the member is in the first orientation, and configured to engage the lock bolt to guide movement of the lock bolt along the path of travel.

32. The assembly of claim 31 wherein the formation also has a second portion configured to be engaged by the member to limit turning movement of the member about the principal axis when the member is in the second orientation.

33. The assembly of claim 32 wherein the first and second portions of the formation extend along opposite sides of the path of travel to engage the lock bolt and to guide movement of the lock bolt along the path of travel.

34. The assembly of claim 33 further comprising a bridging member extending between the first and second portions, wherein the bridging member is configured to engage the lock bolt and to guide movement of the lock bolt along the path of travel.

35. The assembly of claim 34 wherein the bridging member is a pin that has a first end region supported by the first portion and a second end region supported by the second portion.

36. The assembly of claim 35 wherein the pin is a steel roll pin, and the first and second end regions of the pin extend into aligned holes formed in the first and second portions.

37. A handle and housing assembly, comprising:

a) a housing that defines a forwardly facing recess;

b) a shaft connected to the housing and extending rearwardly from the recess along and being turnable relative to the housing about a forwardly-rearwardly extending principal axis of the recess between a first orientation and a second orientation;

c) a handle connected to the shaft for movement among i) an extended position wherein the handle can be grasped to turn the shaft about the principal axis, ii) a first nested position wherein the handle is nested in the recess while the shaft and the handle are in the first orientation, and iii) a second nested position wherein the handle is nested in the recess while the shaft and the handle are in the second orientation; and, d) a housing-connected handle engagement formation configured to extend into a depression defined by the handle to support a portion of the handle and to inhibit turning of the handle about the principal axis when the handle is in a selected one of the first nested position and the second nested position.

38. The assembly of claim 37 wherein the handle has spaced first and second surfaces, and wherein the housing defines at least one additional handle engagement formation that is engageable with at least a selected one of the spaced first and second surfaces to inhibit turning of the handle about the principal axis when the handle is nested.

39. The assembly of claim 37 further comprising a padlock-engageable formation defined by a selected one of the shaft and the handle to be engaged by a padlock to prevent the handle from being moved to the extended position.

40. The assembly of claim 37 further comprising:

a) a control member connected to the shaft at a location spaced rearwardly along the shaft from where the handle is connected to the shaft, and turnable about the principal axis together with the shaft when the shaft is turned by the handle about the principal axis;

b) a housing-supported lock bolt movable along a path of travel between a locked position engaging the control member to prevent turning of the control member about the principal axis, and an unlocked position; and, c) a key-operated lock connected to the housing to move the bolt between the locked and unlocked positions.

41. The assembly of claim 40 wherein rear portions of the housing define spaced first and second guide formations to extend along opposite sides of the path of travel to guide movement of the bolt therealong.

42. The assembly of claim 41 further including a pin extending into aligned holes defined by the first and second guide formations and bridging a space between the first and second guide formations to guide movement of the lock bolt along the path of travel.

43. The assembly of claim 41 wherein the control member is turnable about the principal axis between an operated position and a non-operated position in response to turning of the handle and the shaft about the principal axis between the first orientation and the second orientation, and wherein the lock bolt is engageable with the control member when the control member is in a selected one of the operated and non-operated positions to retain the control member therein.

44. The assembly of claim 41 wherein the control member is engageable with at least a selected one of the first and second guide formations when in a selected one of the operated and non-operated positions.

45. The assembly of claim 41 wherein the control member is engageable with the first guide formation when the control member is in the non-operated position, and is engageable with the second guide formation when the control member is in the operated position.

46. The assembly of claim 40 further comprising a latch element carried by the control member for movement about the principal axis therewith, and wherein the handle is connected to the shaft by a handle-to-shaft connection that includes a cam surface configured to cause forward movement of the shaft, the control member and the latch element along the principal axis when the handle is moved to the first nested position and to the second nested position.

47. The assembly of claim 46 wherein the control member and the latch element are provided with formations that engage to drivingly connect the control member to the latch element in a plurality of possible relative orientations.

48. The assembly of claim 47 wherein at least one of the formations defines an opening configured to receive portions of at least one other of the formations.

49. The assembly of claim 46 wherein the control member and the shaft are provided with formations that engage to drivingly connect the control member to the shaft in a plurality of possible relative orientations.

50. A handle and housing assembly comprising:

a) a housing that defines a forwardly facing recess of a circular shape formed by four contiguously extending pie-shaped, quadrant-like recess sectors arrayed about a forwardly-rearwardly extending principal axis that intersects a center point of the circular recess;

b) a handle sized and shaped to be nestable in the recess of the housing in each of four different orientations wherein the handle, when nested in each of said orientations, overlies a central part of a different one of the recess sectors;

c) a shaft i) extending through the housing along the principal axis, ii) having a front portion pivotally connected at a central location within the recess to the handle to permit the handle to pivot while in any of the four different orientations from being nested in the recess to an extended position wherein the handle projects forwardly from the recess, and iii) being turnable about the principal axis together with the handle when the handle is in the extended position;

d) a member connectable to the shaft along the principal axis at a location behind the recess and being turnable with the shaft to a selected position as the result of the handle being turned, while in the extended position, from one of the four orientations to another of the four orientations; and, e) connection formations on the shaft and on the member that can be assembled in a selection of different ways to enable the handle, when in the extended position, to turn about the principal axis between different selected pairs of the four orientations to turn the member to the selected position.

51. The assembly of claim 50 further comprising a first stop formation defined by the housing and configured to engage the member when the member is in the selected position.

52. The assembly of claim 50 further comprising a lock bolt on the rear side of the housing movable toward and away from a locked position wherein the lock bolt engages the member to retain the member in the selected position.

53. A handle and housing assembly assembled from components that comprise:

a) a housing that defines a forwardly facing recess of a circular shape formed by four contiguously extending pie-shaped, quadrant-like recess sectors arrayed about a forwardly-rearwardly extending principal axis that intersects a center point of the circular recess;

b) a handle sized and shaped to nest in the recess of the housing in each of four different orientations where, in each of the four orientations, the handle, when nested, overlies a central part of a different one of the four recess sectors;

c) a shaft 1) extending through the housing along the principal axis, 2) having a front portion pivotally connected at a central location within the recess to the handle to permit the handle to pivot while in any of the four different orientations from being nested in the recess to an extended position wherein the handle projects forwardly from the recess, and 3) being turnable about the principal axis together with the handle when the handle is in the extended position;

d) a member connectable to the shaft along the principal axis at a location behind the recess and being turnable with the shaft between first and second positions when as the result of the handle being turned, while in the extended position, from one of the four orientations to another of the four orientations; and, e) connection formations on the shaft and on the member that can be assembled in a selection of different ways to enable the handle, when in the extended position, to turn about the principal axis in a selected one of two opposite directions of rotation to and from any selected one of the four different orientations to turn the member between the first and second positions.

54. The set of components of claim 53 further comprising a stop formation defined by the housing and configured to engage the member when the member is turned by the shaft to a chosen one of the first and second positions.

55. The assembly of claim 54 further comprising a lock bolt on the rear side of the housing movable toward and away from a locked position wherein the lock bolt engages the member to retain the member in the chosen one of the first and second positions.

* * * * *